US008443775B2

(12) United States Patent
Ktami et al.

(10) Patent No.: US 8,443,775 B2
(45) Date of Patent: May 21, 2013

(54) SYSTEMS AND METHODS FOR CONTROLLING ENGINE TEMPERATURE

(75) Inventors: Nader Wahid Ktami, Griffin, GA (US); Ryan Arden White, Stockbridge, GA (US); John Harold Lovell, Griffin, GA (US)

(73) Assignee: Caterpillar Inc., Peoria, IL (US)

( * ) Notice: Subject to any disclaimer, the term of this patent is extended or adjusted under 35 U.S.C. 154(b) by 1188 days.

(21) Appl. No.: 12/314,877

(22) Filed: Dec. 18, 2008

(65) Prior Publication Data

US 2010/0154729 A1 Jun. 24, 2010

(51) Int. Cl.
*B60H 1/03* (2006.01)

(52) U.S. Cl.
USPC ..... 123/142.5 E; 123/41.44; 123/41.08

(58) Field of Classification Search
USPC ..... 165/41, 167, 140; 123/41.1, 41.31, 123/41.14, 41.44, 41.47, 41.74, 41.12, 41.29, 123/142.5 H, 142.5 E
See application file for complete search history.

(56) References Cited

U.S. PATENT DOCUMENTS 2,332,149 A * 10/1943 Horton ..... 290/2
5,095,855 A 3/1992 Fukuda et al.
6,032,869 A 3/2000 Ito et al.
6,082,626 A 7/2000 Morikawa et al.
6,199,518 B1 3/2001 Hotta et al.
6,520,136 B2 2/2003 Ito et al.
6,557,502 B2 5/2003 Ban et al.
6,571,752 B1 * 6/2003 Suzuki ..... 123/41.14
6,629,512 B2 10/2003 Iwatani et al.
6,732,942 B1 5/2004 Sangwan et al.
6,880,498 B2 4/2005 Suzuki et al.
7,107,954 B2 9/2006 Yamashita et al.
7,140,330 B2 11/2006 Rogers et al.
7,168,398 B2 1/2007 Ap et al.
8,055,438 B2 * 11/2011 Neisen ..... 701/113
2002/0152979 A1 10/2002 Hayashi et al.
2006/0231640 A1 10/2006 Hashimura et al.

* cited by examiner

*Primary Examiner* — Noah Kamen
(74) *Attorney, Agent, or Firm* — Finnegan, Henderson, Farabow, Garrett & Dunner LLP

(57) ABSTRACT

A system for controlling temperature associated with an engine is provided. The system includes a first fluid circulating system, including a first fluid pump and a heat exchanger. The engine, the first fluid pump, and the heat exchanger are in flow communication. The system also includes an electric power source. The system further includes a second fluid circulating system, including a second fluid pump and a heating element. The engine, the second fluid pump, the heat exchanger, and the heating element are in selective flow communication. The system further includes a sensor associated with the engine, the sensor configured to sense at least one parameter and to generate a signal indicative of the at least one parameter. Moreover, the system includes a controller configured to control operation of the second fluid circulating system in response to the signal, and to control the heating and cooling of the engine.

26 Claims, 2 Drawing Sheets

SYSTEMS AND METHODS FOR CONTROLLING ENGINE TEMPERATURE

TECHNICAL FIELD

The present disclosure relates generally to systems and methods for controlling engine temperature, and more particularly, to systems and methods for cooling and/or heating an engine.

BACKGROUND

An internal combustion engine may be operated in a variety of ambient conditions and under varying loads. For example, an engine may be operated as part of a system for generating electric power, such as, for example, as part of a generator set. A generator set may be operated in high or low ambient temperatures and may be subjected to high or low power loads. As a result, it may be desirable for a system for controlling temperature of the engine to have a flexible capacity for cooling and/or heating the engine.

For example, in order to operate in high ambient temperatures and/or under high power loads, a system for controlling engine temperature may need to be designed to provide high cooling capabilities to meet cooling demands associated with high temperatures and/or high power loads. Such a system may necessitate selection of a high capacity (coolant) pump. One possible drawback of selecting a high capacity pump, however, is that such a pump may result in inefficiencies due, for example, to parasitic losses associated with a high capacity pump, if the ambient temperature and/or power load do not require operation of a high capacity pump. In addition, if the ambient temperature is low and the engine is part of, for example, a generator set that has not been operating, it may be difficult and/or inefficient to start the engine if the engine is relatively cold. Thus, it may be desirable to provide a system for controlling temperature of an engine that operates more efficiently across varying ambient conditions and/or power loads to cool and/or heat the engine.

To reduce the parasitic losses created by a high capacity pump, efforts have been made to include a second pump that assists the first pump in cooling an engine. For example, U.S. Pat. No. 6,082,626 issued to Morikawa et al. on Jul. 4, 2000 ("the '626 patent"), discloses a cooling water system that includes a mechanically-driven first water pump and an electrically-driven second water pump, where both water pumps circulate cooling water through an engine system. The second water pump in the '626 patent helps to circulate an additional amount of cooling water through the system during the engine's operation. Although the second water pump disclosed in the '626 patent may provide additional cooling water through the engine system, the second water pump is only used for cooling the engine system.

The apparatuses of the present disclosure may be directed toward improvements in the existing technology.

SUMMARY

In one aspect, the present disclosure is directed to a system for controlling temperature associated with an engine. The system may include a first fluid circulating system. The first fluid circulating system may include a first fluid pump configured to be driven by the engine. The first fluid circulating system may also include a heat exchanger configured to cool fluid. In the first fluid circulating system, the engine, the first fluid pump, and the heat exchanger may be in flow communication with one another. The system may also include an electric power source. The system may further include a second fluid circulating system. The second fluid circulating system may include a second fluid pump configured to be driven by the electric power source. The second fluid circulating system may also include a heating element configured to heat fluid. In the second fluid circulating system, the engine, the second fluid pump, the heat exchanger, and the heating element may be in selective flow communication with one another. The system may further include a sensor associated with the engine. The sensor may be configured to sense at least one parameter associated with operation of the engine. The sensor may also be configured to generate a signal indicative of the at least one parameter. Moreover, the system may include a controller configured to control operation of the second fluid circulating system in response to the signal, such that when the engine is in operation and the at least one parameter is greater than a predetermined value, the second fluid pump may supply fluid to the heat exchanger and the engine to cool the engine. And when the engine is not in operation, the second fluid pump may supply fluid to the heating element and the engine to heat the engine.

In another aspect, the present disclosure is directed to a system for generating electric power. The system for generating electric power may include an engine configured to supply mechanical power. The system for generating electric power may also include a generator operably coupled to the engine. The generator may be configured to convert mechanical power into electric power. The system for generating electric power may further include an electric power source. Moreover, the system for generating electric power may include a system for controlling temperature of the engine. The system for controlling temperature may include a first fluid circulating system. The first fluid circulating system may include a first fluid pump configured to be driven by the engine. The first fluid circulating system may also include a heat exchanger configured to cool fluid. In the first fluid circulating system, the engine, the first fluid pump, and the heat exchanger may be in flow communication with one another. The system for controlling temperature may also include a second fluid circulating system. The second fluid circulating system may include a second fluid pump configured to be driven by the electric power source. The second fluid circulating system may also include a heating element configured to heat fluid. In the second fluid circulating system, the engine, the second fluid pump, the heat exchanger, and the heating element may be in selective flow communication with one another. The system for controlling temperature may further include a sensor associated with the system for generating electric power. The sensor may be configured to sense at least one parameter associated with the operation of the system for generating electric power. The sensor may also be configured to generate a signal indicative of the at least one parameter. Moreover, the system for controlling temperature may include a controller configured to control operation of the second fluid circulating system in response to the signal, such that when the engine is in operation and the at least one parameter is greater than a predetermined value, the second fluid pump may supply fluid to the heat exchanger and the engine to cool the engine. And when the engine is not in operation, the second fluid pump may supply fluid to the heating element and the engine to heat the engine.

In yet another aspect, the present disclosure is directed to a method for controlling temperature in a system for generating electric power. The method may include supplying power to a first fluid circulating system via an engine. The method may also include supplying power to a second fluid circulating system via an electric power source. The method may further include sensing a parameter associated with operation of the system for generating electric power. Moreover, the method may include supplying fluid via the second fluid circulating system for cooling the engine during operation of the engine if the sensed parameter is greater than a predetermined value, wherein the fluid is passed through a heat exchanger configured to cool the fluid, and for heating the engine if the engine is not in operation, wherein the fluid is exposed to a heating element configured to heat the fluid.

DETAILED DESCRIPTION

Figure 1:
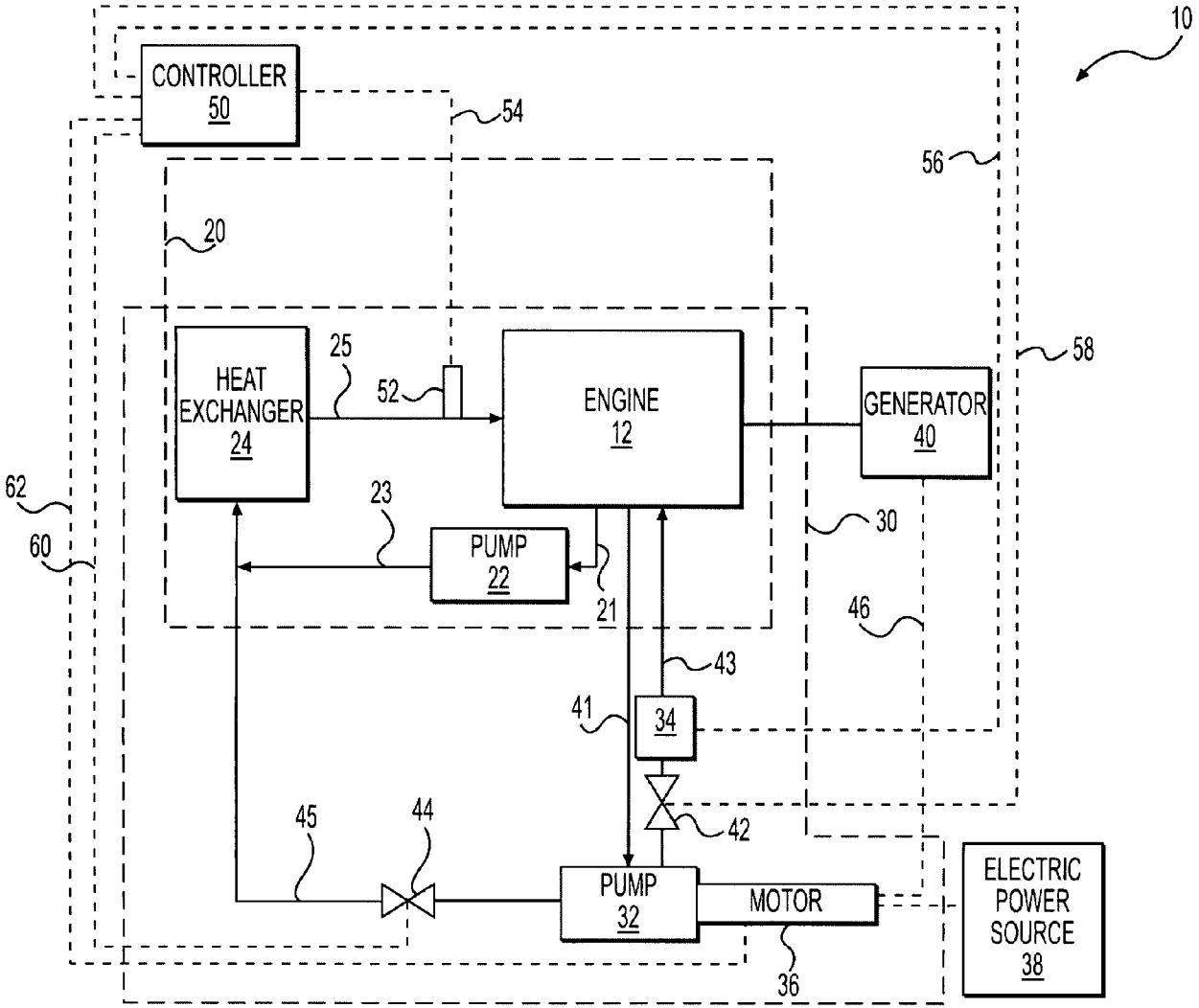
FIG. 1 is a schematic representation of an exemplary embodiment of a system for controlling temperature of an engine.

An exemplary embodiment of a system 10 for controlling temperature of an engine 12 is schematically illustrated in FIG. 1. System 10 may be incorporated into a machine that includes, for example, a system for generating electric power, such as a generator set. System 10 may also be incorporated into a machine such as, for example, an excavator, a dozer, a wheel loader, a backhoe loader, an integrated tool carrier, a skid-steer loader, or any other machine where the use of system 10 may be appropriate to control the temperature of engine 12.

For example, as shown in FIG. 1, system 10 and engine 12 may be incorporated into a system for generating electric power including a generator 40. Engine 12 may be operably coupled to generator 40, and generator 40 may convert mechanical power into electric power. Engine 12 may be an internal combustion engine, such as, for example, a compression-ignition engine, a spark-ignition engine, a gasoline engine, a natural gas engine, or any other engine known in the art.

As shown in FIG. 1, system 10 may include a first fluid circulating system 20 configured to circulate a fluid through engine 12. For example, first fluid circulating system 20 may include a first pump 22 and a heat exchanger 24. First pump 22 may be electrically driven, mechanically driven, or driven in any other manner known in the art. For example, first pump 22 may be operably coupled to engine 12, which supplies power for driving first pump 22. First pump 22 may be in flow communication with engine 12 via a fluid passageway 21 and in flow communication with heat exchanger 24 via a fluid passageway 23. First pump 22 may be configured to cause a fluid (e.g., a coolant and/or antifreeze (e.g., a fluid containing ethylene glycol or other known coolants/antifreezes)) within first fluid circulating system 20 to flow to heat exchanger 24.

In some embodiments, heat exchanger 24 may be in the form of a radiator. However, it is contemplated that heat exchanger 24 may be any appropriate heat exchanger for expelling heat from a fluid passing through heat exchanger 24. For example, in the form of a radiator, heat exchanger 24 may be a liquid-to-air heat exchanger configured to expel heat from first fluid circulating system 20 as coolant flows through heat exchanger 24. Heat exchanger 24 may be in flow communication with engine 12 via a fluid passageway 25, such that coolant may flow from heat exchanger 24 to engine 12 and back to heat exchanger 24, thereby cooling engine 12.

Exemplary system 10 may also include a second fluid circulating system 30 configured to circulate a fluid. Second fluid circulating system 30 may include a second pump 32, a heating element 34, a motor 36, a first valve 42, and a second valve 44. First valve 42 and second valve 44 may be any appropriate valve that may be used to control flow of a fluid. For example, first valve 42 and second valve 44 may solenoid-operated valves or any other valve known in the art.

According to some embodiments, second pump 32 may be in flow communication with engine 12 via a fluid passageway 41. Similarly, heating element 34 may be in flow communication with engine 12 via a fluid passageway 43. Second pump 32 may be in selective flow communication with heating element 34 via fluid passageway 43. First valve 42 may be disposed between second pump 32 and heating element 34. First valve 42 may be configured to move from a first closed position to a second open position, for example. In the first closed position, first valve 42 may prevent flow communication between second pump 32 and heating element 34. In the second open position, first valve 42 may allow flow communication between second pump 32 and heating element 34. In some embodiments, when engine 12 is not operating, and when first valve 42 is in the second open position, heating element 34 may be configured to heat the fluid within second fluid circulating system 30. In such embodiments, second pump 32 may be configured to cause the heated fluid within second fluid circulating system 30 to flow to heating element 34, to engine 12, and back to heating element 34, thereby heating engine 12.

In some embodiments, generator 40 may be configured to serve as an electric power source to supply electric power, i.e., by converting mechanical power supplied by engine 12 into electric power, to motor 36 via a connector 46 (e.g., a cable). In some embodiments, when engine 12 is not in operation, an electric power source 38 may operate to supply electric power to motor 36. With electric power supplied by either generator 40 or electric power source 38, motor 36, in turn, may be configured to drive second pump 32. It is also contemplated that while FIG. 1 illustrates motor 36 and generator 40 as two separate components, in some embodiments, motor 36 and generator 40 may be integrated into a single component. Further, in some embodiments, electric power source 38 may be in the form of electricity provided by an electric utility. It is contemplated that other appropriate electric power sources may be used in system 10.

According to some embodiments, second pump 32 may be in selective flow communication with heat exchanger 24 via a fluid passageway 45. Second valve 44 may be disposed between second pump 32 and heat exchanger 24, and second valve 44 may be configured to move from a first closed position to a second open position. In the first position, second valve 44 may prevent flow communication between second pump 32 and heat exchanger 24. In the second position, second valve 44 may allow flow communication between second pump 32 and heat exchanger 24. In such embodiments, second pump 32 may be configured to cause fluid within second fluid circulating system 30 to flow to heat exchanger 24, to engine 12, and back to heat exchanger 24, thereby supplementing cooling of engine 12 by first fluid circulating system 20.

Still referring to FIG. 1, exemplary system 10 may include a controller 50 and one or more sensors 52. Controller 50 may be configured to control the operation of second fluid circulating system 30. Controller 50 may be an electronic control unit, a processor, a microprocessor, or any other appropriate controller for use with system 10. Sensor 52 may be operably associated with exemplary system 10 and may be configured to sense one or more of a plurality of parameters associated with ambient conditions, and/or operation of engine 12 and/or generator 40. In some embodiments, sensor 52 may be a single sensor configured to sense one or more of the plurality of parameters. Although exemplary sensor 52 is shown in FIG. 1 as being associated with fluid passageway 25, one or more of sensors 52 may be positioned at any location and/or orientation, which facilitates detection of parameters being sensed.

According to some embodiments, the plurality of parameters may include but are not limited to, one or more of the following: ambient temperature, ambient pressure, ambient humidity, altitude, fluid temperature associated with engine 12 such as coolant temperature and/or oil temperature, temperature associated with the fluid in first fluid circulating system 20, temperature associated with the fluid in second fluid circulating system 30, oil pressure associated with engine 12, speed of engine 12, load on engine 12, speed of generator 40, electric load on generator 40, and temperature associated with generator 40, etc. In some embodiments, sensor 52 may be configured to generate signals 54 indicative of one or more of the plurality of parameters associated with ambient conditions and/or operation of engine 12 and/or generator 40. Controller 50 may be configured to receive signals 54. According to some embodiments, different predetermined values may be set for each of the plurality of parameters, such that depending on whether one or more of the plurality of parameters exceeds (e.g., is greater than) or falls below (e.g., is less than) its respective predetermined value, controller 50 may be configured to control operation of second fluid circulating system 30. It is contemplated that in some embodiments, controller 50 may be configured to control operation of second fluid circulating system 30 based on a combination of the plurality of parameters.

According to the exemplary embodiment shown in FIG. 1, controller 50 may be operably associated with second pump 32, heating element 34, first valve 42, second valve 44, and/or sensor(s) 52. In some embodiments, when engine 12 is not in operation, for example, controller 50 may be configured to operate heating element 34, via a signal 56, to heat fluid within second fluid circulating system 30, operate first and second valves 42 and 44, and activate motor 36, thereby operating second pump 32, such that heated fluid is circulated through engine 12. In some embodiments, when engine 12 is in operation, controller 50 may be configured to selectively move first valve 42 between the first closed position and the second open position via a signal 58, in response to signals 54. Similarly, when engine 12 is in operation, for example, controller 50 may be configured to selectively move second valve 44 between the first closed position and the second open position via a signal 60, in response to signals 54. During operation of engine 12, for example, when one or more of the plurality of parameters associated with ambient conditions and/or operation of engine 12 and/or generator 40, such as, for example, the temperature associated with the fluid in first fluid circulating system 20, exceeds (e.g., is greater than) a predetermined value, controller 50 may move second valve 44 to the second open position and allow flow communication between second pump 32 and heat exchanger 24. In such instance, controller 50 may operate second pump 32, via a signal 62 to motor 36, to cause the fluid within second fluid circulating system 30 to flow to heat exchanger 24 and engine 12, thereby supplementing cooling of engine 12 by first fluid circulating system 20. In addition, during operation of engine 12, for example, when one or more of the plurality of parameters associated with ambient conditions and/or operation of engine 12 and/or generator 40, such as, for example, temperature associated with the fluid in first fluid circulating system 20, falls (e.g., is less than) below a predetermined value, controller 50 may deactivate motor 36 and move second valve 44 to the first closed position, thereby preventing flow communication between second pump 32 and heat exchanger 24.

Industrial Applicability

Figure 2:
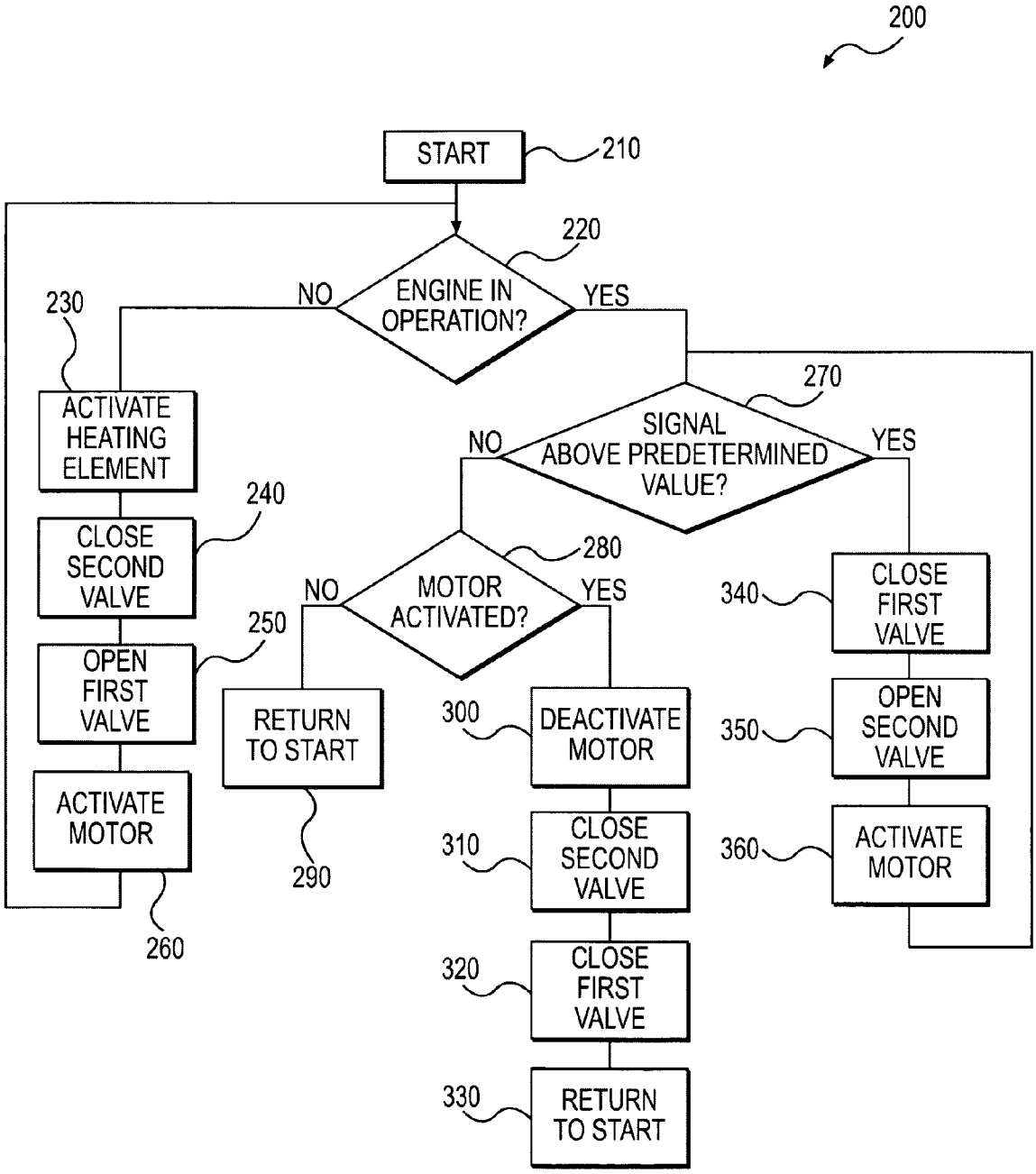
FIG. 2 is a schematic representation of an exemplary embodiment of a method for controlling temperature in a system for generating electric power.

The exemplary disclosed systems and methods may be used in any application where it may be desirable to control temperature associated with an engine during its operation. For example, FIG. 2 illustrates an exemplary method 200 of controlling temperature in a system for generating electric power. Method 200 may start with Step 210. In Step 220, controller 50 determines whether engine 12 is in operation. If engine 12 is not in operation, in Step 230, controller 50 may activate heating element 34 to heat the fluid within second fluid circulating system 30. Method 200 continues with Step 240, where controller 50 may selectively move second valve 44 to the first closed position to prevent flow communication between second pump 32 and heat exchanger 24. In Step 250, controller 50 may selectively move first valve 42 to the second open position to allow flow communication between second pump 32 and heating element 34. In Step 260, controller 50 may activate motor 36, such that second pump 32 may cause the fluid within second fluid circulating system 30 to flow to heating element 34, to engine 12, and back to heating element 34, thereby heating engine 12. Subsequent to Step 260, method 200 may return to Step 220 where controller 50 determines whether engine 12 is in operation. As shown in FIG. 2, when engine 12 is not in operation, method 200 may facilitate warming of engine 12, such that it may help to reduce the amount of fuel needed to start engine 12, for example, between operations of engine 12.

On the other hand, in Step 220, if controller 50 determines that engine 12 is in operation, method 200 may proceed to Step 270. In Step 270, controller 50 determines whether sensor 52 senses that one or more of the plurality of parameters exceeds (e.g., is greater than) a predetermined value. If controller 50 determines that sensor 52 senses that one or more of the plurality of parameters falls below (e.g., is less than) the predetermined value, in Step 280, controller 50 determines whether motor 36 is activated. If motor 36 is not activated, in Step 290, method 200 may return to Start, i.e., Step 210. Alternatively, if motor 36 is activated, in Step 300, controller 50 may deactivate motor 36. In Step 310, controller 50 may move second valve 44 to the first closed position to prevent flow communication between second pump 32 and heat exchanger 24. In Step 320, controller 50 may also move first valve 42 to the first closed position prevent flow communication between second pump 32 and heating element 34. In Step 330, method 200 may return to Start (i.e., Step 210).

However, in Step 270, if controller 50 determines that sensor 52 senses that one or more of the plurality of parameters exceeds (e.g., is greater than) the predetermined value, in Step 340, controller 50 may move first valve 42 to the first closed position to prevent flow communication between second pump 32 and heating element 34. In Step 350, controller 50 may move second valve 44 to the second open position to allow flow communication between second pump 32 and heat exchanger 24. In Step 360, controller 50 may activate motor 36 to operate second pump 32 and cause the fluid within second fluid circulating system 30 to flow to heat exchanger 24, to engine 12, and back to heat exchanger 24, thereby supplementing cooling of engine 12 by first fluid circulating system 20. Subsequent to Step 360, method 200 may return to Step 270 where controller 50 determines whether sensor 52 senses that one or more of the plurality of parameters exceeds (e.g., is greater than) the predetermined value. In such instance, when engine 12 is in operation, second pump 32 may be operated to cause fluid within second fluid circulating system 30 to flow to engine 12 and, in turn, assist first fluid circulating system 20 in cooling engine 12.

Because second pump 32 may help first pump 22 in cooling engine 12, the size of first pump 22 may be reduced and therefore, the cost of system 10 may be reduced. In addition, because second pump 32 may be operated by electric power source 38 rather than engine 12, parasitic losses associated with operation of the engine 12 may be reduced during periods in which first fluid circulating system 20 alone is sufficient to cool engine 12.

It will be apparent to those skilled in the art that various modifications and variations can be made in the disclosed systems and methods for controlling engine temperature. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A system for controlling temperature associated with an engine, the system comprising:

a first fluid circulating system including a first fluid pump configured to be driven by the engine, and a heat exchanger configured to cool fluid, wherein the engine, the first fluid pump, and the heat exchanger are in flow communication with one another;

an electric power source;

a second fluid circulating system including a second fluid pump configured to be driven by the electric power source, and a heating element configured to heat fluid, wherein the engine, the second fluid pump, the heat exchanger, and the heating element are in selective flow communication with one another;

a sensor associated with the engine, the sensor being configured to sense at least one parameter associated with operation of the engine and configured to generate a signal indicative of the at least one parameter; and a controller configured to control operation of the second fluid circulating system in response to the signal, such that when the engine is in operation and the at least one parameter is greater than a predetermined value, the second fluid pump supplies fluid to the heat exchanger and the engine to cool the engine, and when the engine is not in operation, the second fluid pump supplies fluid to the heating element and the engine to heat the engine.

2. The system of claim 1, further including at least one valve in flow communication with the second fluid pump, the engine, the heat exchanger, and the heating element, the at least one valve being movable between a first closed position where fluid communication between the engine and at least one of the heat exchanger and the heating element is prevented, and a second open position where fluid communication between the engine and at least one of the heat exchanger and the heating element is allowed.

3. The system of claim 2, wherein the at least one valve includes a first valve in flow communication with the second fluid pump, the heating element, and the engine, and a second valve in flow communication with the second fluid pump, the engine, and the heat exchanger, and the controller is configured to operate the first valve between a first closed position where fluid communication between the second fluid pump and the heating element is prevented, and a second open position where fluid communication between the second fluid pump and the heating element is allowed, in response to the signal indicative of the at least one parameter.

4. The system of claim 3, wherein, when the engine is in operation, and when the at least one parameter is greater than a predetermined value, the controller is configured to:

move the first valve to the first closed position to prevent flow communication between the second fluid pump and the heating element, move the second valve to the second open position, such that the second fluid pump is in flow communication with the heat exchanger, and operate the second fluid pump to supply fluid to the heat exchanger and the engine to cool the engine.

5. The system of claim 3, wherein, when the engine is in operation, and when the at least one parameter is less than a predetermined value, the controller is configured to:

move the second valve to the first closed position to prevent flow communication between the second fluid pump and the heat exchanger, and move the first valve to the first closed position to prevent flow communication between the second fluid pump and the heating element.

6. The system of claim 3, wherein, when the engine is not in operation, the controller is configured to:

move the first valve to the second open position, such that the second fluid pump is in flow communication with the heating element, move the second valve to the first closed position to prevent flow communication between the second fluid pump and the heat exchanger, activate the heating element to heat the fluid within the second fluid circulating system, and operate the second fluid pump to supply fluid to the engine to heat the engine.

7. The system of claim 1, wherein the at least one parameter includes at least one of temperature associated with the engine, temperature associated with fluid in the first fluid circulating system, temperature associated with fluid in the second fluid circulating system, oil temperature associated with the engine, engine speed, load on the engine, ambient temperature, ambient pressure, ambient humidity, and altitude of the engine.

8. The system of claim 1, wherein the heat exchanger includes a radiator.

9. The system of claim 1, wherein the electric power source includes a utility.

10. The system of claim 1, wherein the second fluid pump provides fluid to the heat exchanger, when the engine is in operation and the at least one parameter is greater than the predetermined value, while the first pump provides fluid to the heat exchanger such that the fluid provided by the second fluid pump to the heat exchanger supplements the fluid provided by the first fluid pump to the heat exchanger.

11. The system of claim 1, wherein when the engine is in operation, heated fluid passes from the engine to the heat exchanger through the first pump.

12. A system for generating electric power, the system comprising:

an engine configured to supply mechanical power;

a generator operably coupled to the engine, the generator being configured to convert mechanical power into electric power;

an electric power source;

a system for controlling temperature of the engine including a first fluid circulating system including a first fluid pump configured to be driven by the engine, and a heat exchanger configured to cool fluid, wherein the engine, the first fluid pump, and the heat exchanger are in flow communication with one another;

a second fluid circulating system including a second fluid pump configured to be driven by the electric power source, and a heating element configured to heat fluid, wherein the engine, the second fluid pump, the heat exchanger, and the heating element are in selective flow communication with one another; and a sensor associated with the system for generating electric power, the sensor being configured to sense at least one parameter associated with operation of the system for generating electric power and configured to generate a signal indicative of the at least one parameter; and a controller configured to control operation of the second fluid circulating system in response to the signal, such that when the engine is in operation and the at least one parameter is greater than a predetermined value, the second fluid pump supplies fluid to the heat exchanger and the engine to cool the engine, and when the engine is not in operation, the second fluid pump supplies fluid to the heating element and the engine to heat the engine.

13. The system of claim 12, further including at least one valve in flow communication with the second fluid pump, the engine, the heat exchanger, and the heating element, the at least one valve being movable between a first closed position where fluid communication between the engine and at least one of the heat exchanger and the heating element is prevented, and a second open position where fluid communication between the engine and at least one of the heat exchanger and the heating element is allowed.

14. The system of claim 13, wherein the at least one valve includes a first valve in flow communication with the second fluid pump, the heating element, and the engine, and a second valve in flow communication with the second fluid pump, the engine, and the heat exchanger, and the controller is configured to operate the first valve between a first closed position where fluid communication between the second fluid pump and the heating element is prevented, and a second open position where fluid communication between the second fluid pump and the heating element is allowed, in response to the signal indicative of the at least one parameter.

15. The system of claim 14, wherein, when the engine is in operation, and when the at least one parameter is greater than a predetermined value, the controller is configured to:

move the first valve to the first closed position to prevent flow communication between the second fluid pump and the heating element, move the second valve to the second open position, such that the second fluid pump is in flow communication with the heat exchanger, and operate the second fluid pump to supply fluid to the heat exchanger and the engine to cool the engine.

16. The system of claim 14, wherein, when the engine is in operation, and when the at least one parameter is less than a predetermined value, the controller is configured to:

move the second valve to the first closed position to prevent flow communication between the second fluid pump and the heat exchanger, and move the first valve to the first closed position to prevent flow communication between the second fluid pump and the heating element.

17. The system of claim 14, wherein, when the engine is not in operation, the controller is configured to:

move the first valve to the second open position, such that the second fluid pump is in flow communication with the heating element, move the second valve to the first closed position to prevent flow communication between the second fluid pump and the heat exchanger, activate the heating element to heat the fluid within the second fluid circulating system, and operate the second fluid pump to supply fluid to the engine to heat the engine.

18. The system of claim 12, wherein the at least one parameter includes at least one of temperature associated with the engine, temperature associated with fluid in the first fluid circulating system, temperature associated with fluid in the second fluid circulating system, oil temperature associated with the engine, engine speed, load on the engine, ambient temperature, ambient pressure, ambient humidity, altitude of the engine, speed of the generator, load on the generator, and temperature associated with the generator.

19. The system of claim 12, wherein the second fluid pump provides fluid to the heat exchanger, when the engine is in operation and the at least one parameter is greater than the predetermined value, while the first pump provides fluid to the heat exchanger such that the fluid provided by the second fluid pump to the heat exchanger supplements the fluid provided by the first fluid pump to the heat exchanger.

20. The system of claim 12, wherein when the engine is in operation, heated fluid passes from the engine to the heat exchanger through the first pump.

21. A method for controlling temperature in a system for generating electric power, the method comprising:

supplying power to a first fluid circulating system via an engine, the first fluid circulating system including a heat exchanger configured to cool fluid entering the engine;

supplying power to a second fluid circulating system via an electric power source;

sensing a parameter associated with operation of the system for generating electric power; and supplying fluid via the second fluid circulating system for cooling the engine during operation of the engine if the sensed parameter is greater than a predetermined value, wherein the fluid is passed through the heat exchanger of the first fluid circulating system during operation of the engine, and heating the engine if the engine is not in operation, wherein the fluid is exposed to a heating element configured to heat the fluid.

22. The method of claim 21, further including, when the engine is in operation preventing flow communication between a fluid pump associated with the second fluid circulating system and the heating element, and allowing flow communication between the fluid pump and the heat exchanger when the sensed parameter is greater than the predetermined value.

23. The method of claim 21, further including, when the engine is in operation preventing flow communication between a fluid pump associated with the second fluid circulating system and the heating element, and preventing flow communication between the fluid pump and the heat exchanger when the sensed parameter is less than the predetermined value.

24. The method of claim 21, further including, when the engine is not in operation preventing flow communication between a fluid pump associated with the second fluid circulating system and the heat exchanger, and allowing flow communication between the fluid pump and the heating element.

25. The method of claim 21, further including providing fluid to the heat exchanger with the second fluid circulating system, when the engine is in operation and the at least one parameter is greater than the predetermined value, while the first fluid circulating system provides fluid to the heat exchanger such that the fluid provided by the second fluid circulating system to the heat exchanger supplements the fluid provided by the first fluid circulating system to the heat exchanger.

26. The method of claim 21, further including passing heated fluid from the engine to the heat exchanger through a first pump of the first fluid circulating system when the engine is in operation.

* * * * *